US005102351A

United States Patent [19]

Meshel

[11] Patent Number: 5,102,351

[45] Date of Patent: Apr. 7, 1992

[54] SHIELDED ELECTRIC CABLE AND HARNESS WITH STRAIN RELIEF

[75] Inventor: David C. Meshel, Sunnyvale, Calif.

[73] Assignee: The United States of America as represented by the Secretary of the Air Force, Washington, D.C.

[21] Appl. No.: 619,851

[22] Filed: Nov. 29, 1990

[51] Int. Cl.[5] ..... H01R 13/648

[52] U.S. Cl. ..... 439/607; 439/610; 439/585

[58] Field of Search ..... 439/575-585, 439/161, 607-610, 932, 449, 456, 457

[56] References Cited

U.S. PATENT DOCUMENTS

| | | | |
|---|---|---|---|
| 3,037,069 | 5/1962 | Wilson | 439/579 |
| 3,622,952 | 11/1971 | Hilbert | 339/117 R |
| 3,830,957 | 8/1974 | Oberdiear | 174/78 |
| 3,967,050 | 6/1976 | Makihara et al. | 439/449 |
| 3,990,765 | 11/1976 | Hill | 439/580 |
| 4,026,628 | 5/1977 | Duffner et al. | 439/585 |
| 4,243,290 | 1/1981 | Williams | 439/610 |
| 4,804,338 | 2/1989 | Dibble et al. | 439/583 |
| 4,921,449 | 5/1990 | Fish | 439/585 |

OTHER PUBLICATIONS

Bunker Ramo Corp., A New Coaxial Connector, Oct. 1978 pp. 186-192.

*Primary Examiner*—Larry I. Schwartz
*Assistant Examiner*—Hien D. Vu
*Attorney, Agent, or Firm*—Thomas C. Stover; Donald J. Singer

[57] ABSTRACT

In an electric cable and harness, the harness having a backshell-connector assembly with a hollow cable entry flange at the rear of the backshell, a plurality of cables, each cable having one or more metal conductors within an insulating sleeve and within a flexible metallic tubular shield, the ends of the conductors being uncovered for attachment to the connector, improvements are provided in which the shield tubes or pigtails, are folded back from the uncovered conductor ends, from within the rear flange and around to the outside surface thereof and clamped therearound. Such conductors have extra length or slack within the backshell e.g. helically wind to the connector attachments so that upon pulling the cables against the backshell, the conductors will extend and provide flexible strain relief for the conductors at such connector attachments. Such flexible harness attachment also permits considerable twist between backshell and cable without breaking the individual conductors at or near such attachments and permits small gauge, light weight, conductors to be employed at a considerable weight savings in, e.g. aircraft or space vehicles.

11 Claims, 2 Drawing Sheets

SHIELDED ELECTRIC CABLE AND HARNESS WITH STRAIN RELIEF

STATEMENT OF GOVERNMENT INTEREST

The invention described herein may be manufactured and used by or for the Government for governmental purposes without the payment of any royalty thereon.

BACKGROUND OF THE INVENTION

This invention relates to a shielded electric cable and harness particularly one with strain relief for the conductors therein.

THE PRIOR ART

In electric cable harnesses, metal braid shielding is used to prevent signals on the inside of the cable from being interfered with by signals on the outside of the cable bundle. Effective shielding is required due to the delicacy of instrumentation, e.g., in aircraft, spacecraft and satellites. In addition to normal electrical interference it is often required that the electrical systems in the above vehicles be shielded from electromagnetic pulses (EMP) due to nuclear detonations and electromagnetic interference (EMI) due to radio or radar waves or other radiation.

Additional problems for such electric harnesses include excess weight and breakage of wires therein at the junction thereof in the backshell with a connector, due to pulling and/or twisting of the cable. For example, when a satellite deploy a probe arm in space, such arm may first pivot 90°, then rotate 90°, applying considerable strain forces to conductors in a backshell.

To guard against the above breakage, the prior art has used relatively heavy gauge conductors and has applied annular clamping collar or sleeve means to the cable, where it enters the backshell. See for examples, U.S. Pat. No. 3,622,952 to Hilbert (1971) and U.S. Pat. No. 4,804,338 to Dibbie et al. (1989). These stiff collar or sleeve arrangements just transfer the break-point of the individual conductors in the cable, outside of the backshell and make for a relatively stiff juncture of cable to backshell, i.e. provide little twistability or flexibility thereat. Accordingly, there is a need and market for an electrical cable and harness, that overcomes the above prior shortcomings. By "harness" is meant the backshell-connector assembly.

There has now been discovered an electric cable and harness combination in which the individual conductors are joined to the connector of the terminal in such a configuration as to provide strain relief thereat while also providing twistability and flexability between cable and backshell. Further in some embodiments, double shielding against radiation is provided.

SUMMARY OF THE INVENTION

Broadly the present invention provides an electric cable and harness comprising a plurality of cables and a backshell-connector assembly with a hollow cable entry flange at the rear of the backshell, each cable having a metal conductor or a plurality thereof within an insulating coating or sleeve (to define a wire) and within a flexible metallic tubular shield, the conductor metal ends being bared for attachment to the connector, the improvement comprising, shield tubes which are folded back from the wire or conductor ends from within the entry flange and around it to the outside surface thereof and means for clamping such shield tubes therearound.

In another improvement, the uncovered conductors have extra length or slack within the backshell so that upon pulling of the cable against the backshell, such conductors will extend and provide flexible strain relief for their connector attachments therein.

In another embodiment, an exterior shield fits around cable and backshell and is secured to the exterior of the backshell.

BRIEF DESCRIPTION OF THE DRAWINGS

The invention will become more apparent from the following detailed specification and drawings in which.

DESCRIPTION OF PREFERRED EMBODIMENTS

Figure 1:
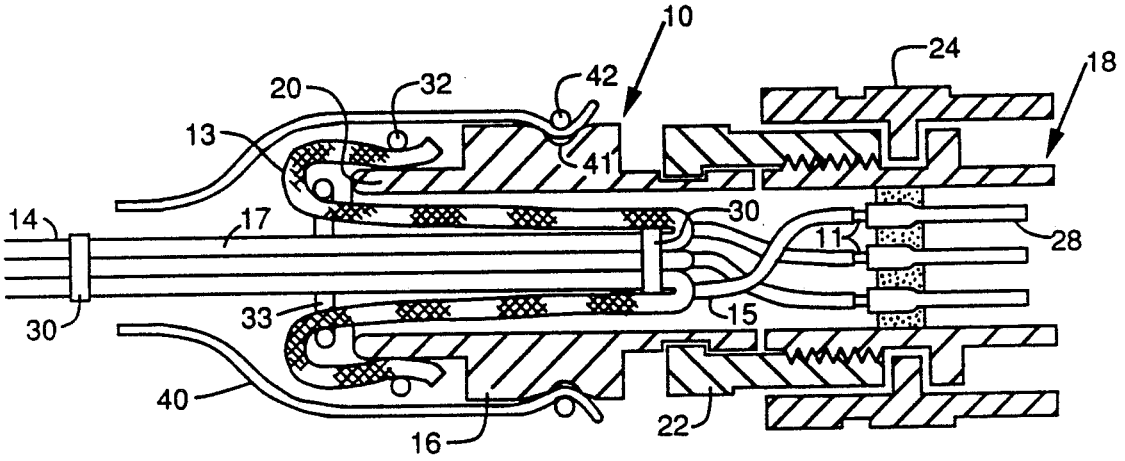
FIG. 1 is an elevation view partly in section, of cable, backshell and connector embodying the present invention.
Figure 2:
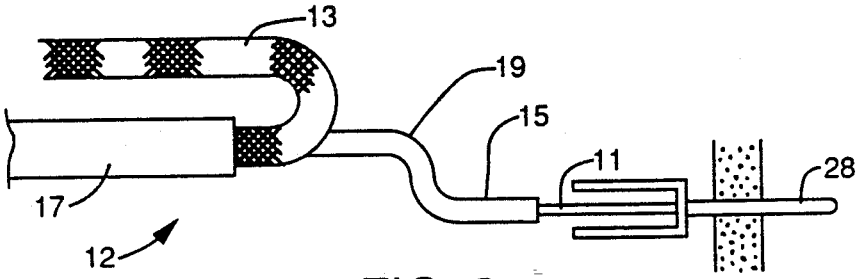
FIG. 2 is a elevation view of components of the invention shown in FIG. 1.

Referring in more detail to the drawings, backshell 10 receives the individual cables 12 of cable bundle 14, as shown in FIGS. 1 and 2. The backshell 10 has housing 16 with connector 18 mounted thereto by spin coupler 22, as shown in FIG. 1. Hollow rounded cable entry flange 20 extends aft of the backshell housing 16 and collar 24 is rotatably mounted on the connector 18 in grooved engagement therewith, as shown in FIG. 1.

In the cable bundle 14, each cable 12 has an exterior insulating sleeve 17 within which is a woven metallic tubular sleeve within which is another insulating or dielectric coating 15 within which is the metal conductor 11 (or plurality of conductor strands), as shown or indicated in FIGS. 1 and 2.

The cable bundle 14 is inserted into the cable entry flange 20 and each individual cable 12 is fastened to a prong 28 of the connector 18 as follows.

As shown in FIG. 2, the outer insulating sleeve 17 is cut back a suitable distance from the cable end to uncover the woven metallic sleeve 13, which is, e.g. pulled and stretched and cut enough to free it from the coated conductors within so it can be folded back on the cable 12. The coating is then cut back from the conductor end a suitable distance to bare the one or more conductors 11 therein, as shown in FIG. 2. The conductor end is then inserted into the back recess of a connector prong 28, which prong is crimped thereover, as indicated in FIG. 2.

Figure 3:
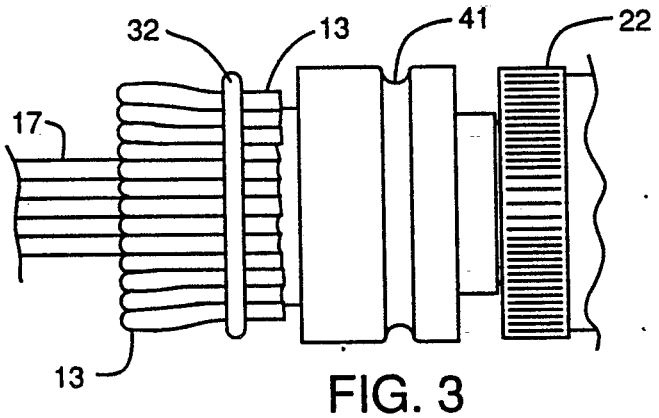
FIG. 3 is a fragmentary elevation of components of the invention shown in FIG. 1.

The so-freed metallic sleeve segment or pigtail 13 is then folded back around bundle tie 30, counter to the direction of the inserted cable bundle 14 to emerge outside of the entry flange 20 whereupon it reverses direction and wraps around the end thereof, as shown in FIGS. 2 and 3.

Each cable 12 is thus uncovered and mounted in the backshell 10 to the connector 18, with each pigtail 13 reversing and wrapping around the cable entry flange 20 and arranged about the outside periphery of such flange 20, after which a lock ring 32 e.g., of nickel-titanium alloy is positioned thereover and heat-shrunk into clamping engagement therewith, as shown or indicated in FIGS. 1 and 3.

As shown in FIG. 2, slack in the form of curve or hump 19 is left on each coated conductor 15 so that upon pulling the cable bundle 14 away from the backshell 10, such conductors will extend and take up slack and provide some strain relief to the the crimped conductors 11 as shown or indicated in FIGS. 1 and 2. As indicated in FIG. 1, the coated conductors 15 can curve or wind to the connector prongs in helical fashion or in a pre-twist, for cable-harness flexibility. The pigtails 13 can also be thus curved as they wind out of the backshell. Such curves or slack in the coated conductor connections permits such flexibility and freedom of movement that the cable can be considerably twisted (particularly in the direction opposite to that of the pre-twist) relative to the backshell without breaking the individual conductors in such backshell. Moreover the cable can bend up to 180 degrees or more relative to the harness of the invention without conductor breakage. Such flexibility and twistability of the cable/backshell mounting of the invention are important to the use thereof in e.g., pivot arm operations of satellites as discussed below.

The cables are desireably tied together in the backshell, e.g. per FIG. 1, so that 1) they twist or extend together and 2) a pull or strain on any one cable is distributed to and borne by all cables and connector attachments.

Further the pigtails 13 as wrapped around the cable entry flange, per FIGS. 1 and 3, form a radiation shield where such cable bundle 14 enters such flange 20.

Figure 4:
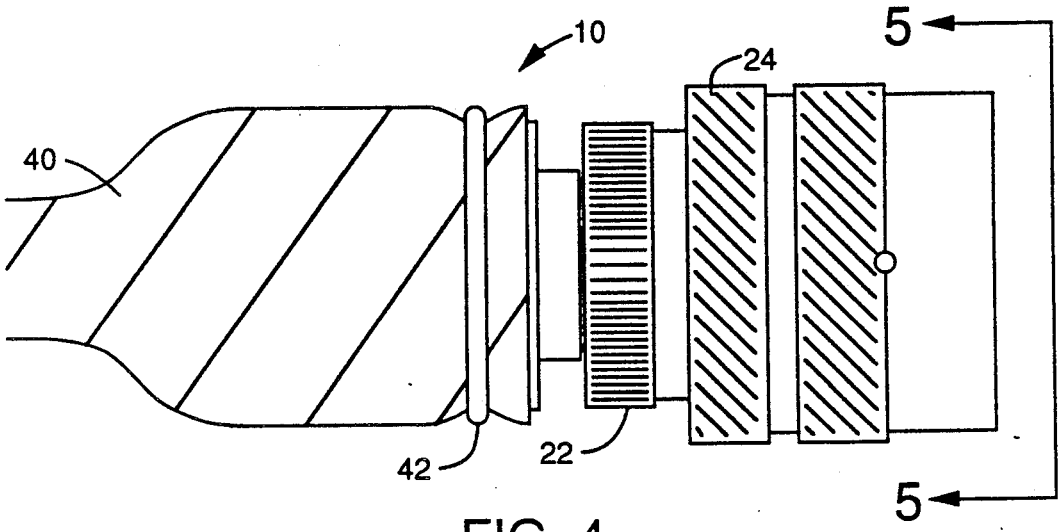
FIG. 4 is an elevation view of the embodiment shown in FIGS. 1 and 3.
Figure 5:
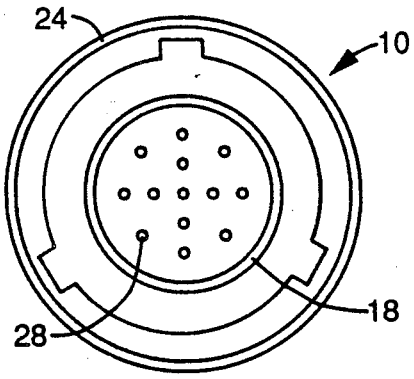
FIG. 5 is an end elevation view of the embodiment shown in FIG. 4, taken on lines 5—5, looking in the direction of the arrows.

By way of further radiation protection, radiation shield 40, in the form of an outer sleeve or wrap encloses or is wrapped around cable bundle 14 and backshell 10 and secured to such backshell by lock ring 42 as shown in FIGS. 1 and 4. Again, the lock ring 42 is of nickel-titanium alloy and heat shrunk in place in the manner discussed above with respect to lock ring 32. However, to better secure such lock ring, a peripheral groove 41 is formed in the foward portion of the cable entry flange, as shown in FIGS. 1 and 3, which groove 41 receives a peripheral segment of the outer shield 40 as clamped therein by the lock ring 42, in slip resistant engagement, as shown in FIG. 4. The thus joined and shielded cable and harness are shown in FIGS. 4 and 5 wherein each prong 28 is crimped to a conductor 11 in the cable bundle 14, as shown in FIGS. 1 and 2.

The harness of the present invention thus provides for double shielding, where the conductors enter the backshell i.e., provides individual conductor shield terminations under a lock ring 32 and an overall shield termination under lock ring 42.

Further the cable-backshell mounting of the invention provides strain relief to the individual conductors as well as flexibility and twistability thereof, as discussed above. In fact, the cable to backshell mounting is so flexible as to allow the cable to flex 180° or more, for handling, installation and operational purposes without straining the wires attached to the connector.

In fact, so effective is the cable-backshell mounting of the invention that lighter guage wire (i.e. conductors) can be employed than in similar prior art mountings. That is, prior art methods have required the use of, e.g. 22 gauge wire to minimize or reduce breakage at the connector mounting. The harness of the present invention, however can successfully use 30 gauge wire (in each cable) for a considerable weight savings. For example 1,000 feet of 22 gauge copper wire weighs 1.31 lbs. while 1,000 feet of 30 gauge copper wire weighs 0.367 lbs.

The significance of such weight savings becomes apparent when it is realized that is the cost of launching a space vehicle is about $70,000 to $80,000 per lb. The cable-backshell mounting of the present invention saves about 1.0 to 1.5 oz. per mounting over those of the prior art. On an existing satelite for the lighter cable bundle and harness of the invention, this can amount to a weight savings of, e.g. 90 lbs.

The cable and harness of the present invention is highly suitable for space vehicles for another reason. That is, the flexibility and twistability of the cable-backshell termination of the present invention is highly suitable for use in e.g., satellite arms which, for example, deploy 90 degrees and rotate 90 degrees and can do so without conductor breakage in the harness of the present invention.

While 30 gauge wire is preferred for purposes of the present invention as discussed above, 20 to 30 gauge wire can be employed in such harness as desired, within the scope of the invention. The conductors as noted, can be of copper or berilium-copper or other copper alloy.

The outer radiation shield can be of various reflective material. However copper foil with a "mylar" backing is preferred. The (inner) cable shields are preferably woven sleeves of metal, e.g. aluminum.

It is noted that the outer harness shield provides up to 90 percent or more protection from radiation such as EMP and EMI, while the inner shield provides the rest of the radiation protection.

The backshell housing and other components are of metal, e.g. aluminum.

The bare conductors are attached to the connector by crimping, soldering and the like.

In tying back the pigtails, a cable tie 33 per FIG. 1 is placed behind the cable entry flange, the cable shields or pigtails, are brought out of the backshell and wrapped over such cable tie and over the cable entry flange. The lock ring is then secured in place and the cable tie removed.

Thus the cable backshell termination of the invention is a light weight, 360°, EMI, EMP shield termination for circular or rectangular type electrical connectors. The back-shell provides for multiple layers of shield termination using heat shrinkable rings or similar clamping devices.

The cable backshell mounting of the invention can be used with any type of conductor, single wire, TSP, overbraid and the like and virtually any size gauge e.g., 20 gauge through 30 guage or more, of available wire.

I claim:

1. An electric cable and harness comprising a plurality of cables and a backshell-connector assembly with a hollow cable entry flange at the rear of such backshell, each cable having one or more metal conductors within an insulating sleeve within a flexible metallic tubular shield, the ends of the conductors being uncovered for attachment to said connector, the improvement comprising, shield tubes which are folded back from the uncovered conductor ends from within said rear entry flange and then folded around it to the outside surface thereof and means for clamping said shield tubes therearound, to press portions of the shield tubes inwardly toward the axis of said rear entry flange said uncovered conductors having extra length or slack within said backshell so that upon pulling of the cable against the backshell, said conductors will extend and provide flexible strain relief for the conductors attached therein.

2. The harness of claim 1 wherein the uncovered conductors have a curve, helix or other slack therein for flexibility and twistability between cable, backshell and connector.

3. The harness of claim 1 wherein a lock ring clamps the folded-back shield tubes around the periphery of said flange.

4. The harness of claim 1 wherein said cable includes conductors of 30 guage wire each separately fastened to the backshell connector.

5. The harness of claim 1 having an outside shield wrap which covers at least part of the cable, covers the shield tubes clamped around the backshell and covers at least part of the backshell.

6. The harness of claim 5 wherein said backshell has a groove around the periphery thereof and spaced forward of said cable entry flange and where said shield tubes are clamped around the periphery thereof and a second lock ring to clamp said outside shield around said backshell and into said groove.

7. The harness of claim 6 wherein said outside shield is a helical wrap of copper foil with a mylar inside backing.

8. The harness of claim 6 wherein said lock rings are heat shrunk rings of nickel-titanium alloy.

9. The harness of claim 6 wherein said inner shield clamping arrangement takes a major part of the strain relief off the conductors in the backshell and said outside shield takes up a portion of said strain relief and both shields reflect or ward off exterior radiation.

10. The harness of claim 1 wherein said conductors are wound helically or pre-twisted in the backshell.

11. The harness of claim 10 wherein the folded-back shield sleeves or pigtails are also wound helically or pre-twisted as they wind out of the back shell.

* * * * *